US008899905B2

(12) United States Patent
Helgesson

(10) Patent No.: US 8,899,905 B2
(45) Date of Patent: Dec. 2, 2014

(54) BOOM TRUCK FOR HANDLING LOADS ABOVE AND BELOW GROUND LEVEL

(75) Inventor: Kenneth Helgesson, Lidhult (SE)

(73) Assignee: Cargotec Patenter AB, Ljungby (SE)

( * ) Notice: Subject to any disclaimer, the term of this patent is extended or adjusted under 35 U.S.C. 154(b) by 694 days.

(21) Appl. No.: 12/810,604

(22) PCT Filed: Dec. 23, 2008

(86) PCT No.: PCT/SE2008/000745
§ 371 (c)(1),
(2), (4) Date: Jun. 25, 2010

(87) PCT Pub. No.: WO2009/084994
PCT Pub. Date: Jul. 9, 2009

(65) Prior Publication Data

US 2010/0288718 A1 Nov. 18, 2010

(30) Foreign Application Priority Data

Dec. 27, 2007 (SE) ..... 0702876

(51) Int. Cl.
*B66F 9/065* (2006.01)
*B66F 9/18* (2006.01)

(52) U.S. Cl.
CPC ..... *B66F 9/186* (2013.01); *B66F 9/0655* (2013.01)
USPC ..... 414/547; 414/555; 414/680; 414/728; 414/736; 212/261; 212/264

(58) Field of Classification Search
USPC ..... 212/168, 258, 260, 261, 264, 299, 306, 212/347–350; 414/547, 549, 550, 555, 680, 414/718, 728, 736
See application file for complete search history.

(56) References Cited

U.S. PATENT DOCUMENTS

| | | | | | |
|---|---|---|---|---|---|
| 3,967,744 | A | * | 7/1976 | Goyarts | 414/707 |
| 4,206,833 | A | | 6/1980 | Goyarts | |
| 4,700,851 | A | * | 10/1987 | Reeve et al. | 212/181 |
| 4,775,288 | A | * | 10/1988 | Dimitriu | 414/708 |
| 4,881,865 | A | * | 11/1989 | Herolf | 414/550 |
| 4,892,201 | A | | 1/1990 | Hellwig et al. | |

(Continued)

FOREIGN PATENT DOCUMENTS

| | | |
|---|---|---|
| EP | 1 061 034 | 12/2000 |
| JP | 53-57653 | 5/1978 |

(Continued)

OTHER PUBLICATIONS

English translation of JP 2004-35253 A.*
Supplementary European Search Report dated Feb. 1, 2013 issued in European Patent Application No. 08868962.5, 8 pp.

*Primary Examiner* — Sang Kim
*Assistant Examiner* — Nathaniel Adams
(74) *Attorney, Agent, or Firm* — Nixon & Vanderhye P.C.

(57) ABSTRACT

A boom truck includes a telescopic lifting boom with a lifting unit and a support structure having a first support arranged on the chassis of the boom truck. A second support in the form of an elongated bearing and support beam body extends in the longitudinal direction of the boom truck. The beam body is pivotally mounted to the first support about a rear bearing axis, whereas the lifting boom is pivotally mounted to beam body about a front bearing axis. Actuators act on the beam body and the lifting boom as a unit and act to pivot the lifting boom about the front bearing axis.

16 Claims, 4 Drawing Sheets

(56) References Cited

U.S. PATENT DOCUMENTS

| | | | | |
|---|---|---|---|---|
| 4,964,778 | A * | 10/1990 | Muto et al. | 414/700 |
| 6,024,232 | A | 2/2000 | Helgesson | |
| 6,435,805 | B1 * | 8/2002 | Smith | 414/543 |
| 2004/0210342 | A1 | 10/2004 | Magni | |

FOREIGN PATENT DOCUMENTS

| | | |
|---|---|---|
| JP | 53-057653 | 5/1978 |
| JP | 61-49786 | 4/1986 |
| JP | 2-304123 | 12/1990 |
| JP | 2004-35253 | 2/2004 |

* cited by examiner

BOOM TRUCK FOR HANDLING LOADS ABOVE AND BELOW GROUND LEVEL

This application is the U.S. national phase of International Application No. PCT/SE2008/000745 filed 23 Dec. 2008 which designated the U.S. and claims priority to Swedish Patent Application No. 0702876-4 filed 27 Dec. 2007, the entire contents of each of which are hereby incorporated by reference.

BACKGROUND OF THE INVENTION

The present invention relates to a boom truck adapted for handling a unitary load, such as a container and the like, both above as well as below ground level, comprising

- an elongated chassis having
  - a front end, and
  - a rear end,
- a front pair of wheels,
- a rear pair of wheels,
- a telescopic lifting boom having
  - a base portion with a rear end and a front end, and
  - a telescopic arm defining the front end of the lifting boom, wherein the lifting boom is
    - pivotally mounted for pivoting in a vertical plane and extends above the chassis and past the front pair of wheels of the chassis,
- a lifting unit, which is arranged in connection to the front end of the lifting boom and is separated by a space from the front end of the chassis, as seen in the starting position of the lifting boom, for carrying the unitary load,
- a support structure for supporting the lifting boom, said support structure comprising
  - a first support arranged on the chassis at the rear portion thereof, for extending in a direction upwards.

The expression "container" refers to a transport container for goods, intended for repeated use and designed so that it can be handled and moved as a unit without reloading of the goods. By using standardized container sizes and specially adapted transporting means and handling equipments, containers with goods can be transported quickly and safely from e.g. a manufacturing company to a customer. The containers which can be handled by the boom truck according to the present invention are very heavy and can weigh up to 45 tons, with goods.

U.S. Pat. No. 6,024,232 describes a boom truck having a support structure for supporting a telescopic lifting boom, said support structure consisting of only one stand which is pivotally journalled to the chassis and the lifting boom to enable raising and lowering of the lifting boom from a horizontal, lower transport position, to a horizontal, upper working position. The previously known boom truck cannot perform handling of unitary loads, such as containers, to and from levels below the supporting plane of the boom truck, so called negative lifts.

U.S. Pat. No. 4,964,778 describes a forklift truck having a boom structure consisting of a main boom and an auxiliary boom, which are articulately connected to each other via a knee-joint resembling fly section in order to enable handling of loads below the ground level. The purpose of the forklift truck is to achieve high heights and long reach in front of the truck, above and below the ground level, with its two-part boom design. The design and mounting to the chassis of the boom structure should be sufficient for handling such light loads which can be carried by its fork. However, the forklift truck according to this document is not suited for handling of heavy loads, weighing over 4 tons, since the design and mounting of the boom structure result in instability when handling heavier loads, which instability can lead to increased harmful stresses on the boom structure and which can also produce undesired oscillating movements of the heavy load with accompanying increase of said stresses. Accordingly, it is not possible to replace the fork of the forklift truck according to U.S. Pat. No. 4,964,778 with a lifting yoke for handling of containers of the type of standardized goods containers which are used for smooth transport of goods with e.g. special container ships and handling in container terminals, which containers can weigh up to 45 tons, with goods.

SUMMARY OF THE INVENTION

The object of the present invention is to achieve an improved boom truck of the kind described in the introduction, which is sufficiently stable to be capable of handling a heavy unitary load with a weight up to 45 tons, such as a container, above as well as below the ground level, e.g. in connection with unloading or loading of a container ship, such as for example a barge, which is located at a loading dock.

The boom truck according to the invention is characterized in

- that the lifting boom is non-articulated,
- that the support structure further comprises a second support, in the form of an elongated, linear bearing and support beam body for mounting and supporting the lifting boom, said bearing and support beam body extending in the longitudinal direction of the boom truck and having a rear end located in the vicinity of the rear end of the chassis, and a front end located in the vicinity of the front end of the chassis,
- that the bearing and support beam body is pivotally mounted to the first support about a horizontal, rear bearing axis located in the vicinity of the rear end of the bearing and support beam body,
- that the lifting boom is pivotally mounted to the bearing and support beam body about a horizontal, front bearing axis, which is parallel with the rear bearing axis and which is located in the vicinity of the front end of the bearing and support beam body and in the vicinity of the front end of the base portion of the lifting boom, and
- that the support structure further comprises
  - an actuator for raising and lowering the bearing and support beam body and the lifting boom as a unit, while pivoting about the rear bearing axis during said handling of the unitary load above the ground level, and
  - an actuator for pivoting the lifting boom about the front bearing axis during said handling below the ground level.

BRIEF DESCRIPTION OF THE DRAWINGS

The invention will be described further with reference to the drawings.

DETAILED DESCRIPTION OF THE INVENTION

Figure 1:
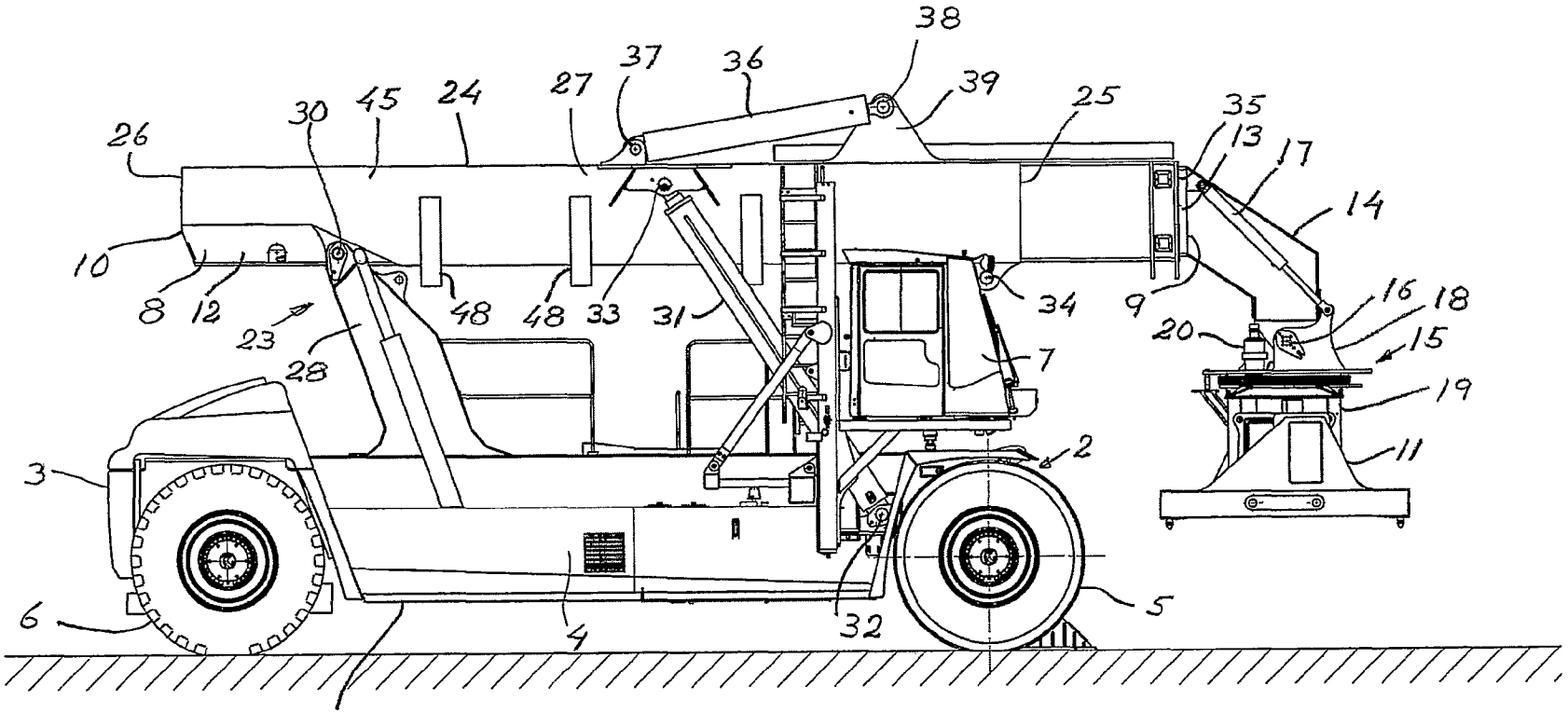
FIG. 1 is a side view of a boom truck according to one embodiment of the invention.

A truck of the type which is commonly referred to as a boom truck is shown schematically in the drawings. The boom truck has an elongated chassis 1 having a front end 2, a rear end 3 and a central portion 4 located between said ends 2, 3, wherein the expressions "front end" and "rear end" refer to the truck's normal driving direction from one location to another with or without load. Furthermore, the truck has a front pair of wheels 5, a rear pair of wheels 6, an operator's cab 7 located above and obliquely behind the front pair of wheels 5, and an elongated, linear, non-articulated telescopic lifting boom 8 having a front end 9 and a rear end 10. The operator's cab 7 is located laterally to a vertical centre plane C of the boom truck. The expression "non-articulated" means that the lifting boom is designed to be permanently linear, i.e. it lacks a knee joint dividing the lifting boom into two boom sections, where the outer boom section can be pivoted to be set at an angle relative to the inner boom section, as is the case for the boom truck according to U.S. Pat. No. 4,964,778. The two pairs of wheels 5, 6 are arranged in the vicinity of the front end 2 and rear end 3, respectively, of the chassis 1. The telescopic lifting boom 8 extends centrally above the chassis 1, from a position approximately above the rear pair of wheels 6, past the front pair of wheels 5, and to a predetermined position in front of the front pair of wheels 5. The lifting boom 8 carries a lifting unit 11 and comprises a hollow, rear base portion or outer boom 12 with a rectangular cross-section, and a front telescopic arm or inner boom 13 with a rectangular cross-section, projecting from the same. The projection and retraction of the front telescopic arm 13 out of and into, respectively, the rear base portion 12 takes place by means of an actuator (not shown), preferably hydraulic cylinders, in the rear base portion 12. Alternatively, the non-articulated lifting boom 8 can also comprise one or several intermediate telescopic arms.

The lifting unit 11 is arranged in connection with the front end 9 of the lifting boom and is separated by a predetermined space from said end 9, as seen in the starting position of the lifting boom 8, i.e. with a completely retracted front telescopic arm 13 in accordance with FIG. 1.

The front telescopic arm 13 is rigidly connected to a downwardly directed, angle-shaped connecting part 14 carrying a coupling device 15, which is pivotally mounted in bearings to the connecting part 14 about a horizontal axis 16, which is perpendicular to the vertical centre plane C of the boom truck. A hydraulic cylinder 17 extends on each side of the connecting part 14 and has its ends articulately mounted to the connecting part 14 and the coupling device 15, wherein the coupling device 15 can be pivoted in a desired direction about said axis 16 in a controllable way by means of the two hydraulic cylinders 17. The coupling device 15 has an upper member 18, which is stationary with respect to the vertical centre line of the coupling device 15, and a lower member 19, which is rotatable about said vertical centre line, wherein the two members 18, 19 are connected to each other in their horizontal boundary plane via upper and lower gear rims, which are in rotating engagement with each other. Accordingly, the lower, rotatable member 19 of the coupling device 15 can be rotated in a controllable way in desired directions in a circumferential direction and with desired distances. For this purpose, two hydraulic motors 20 are arranged on top of said upper, stationary gear rim and arranged in engagement with the lower, rotatable gear rim for rotating the same. The lifting unit 11 is releasably suspended from the lower, rotatable member 19 of the coupling device 15. In the embodiment shown, the lifting unit 11 consists of a top lifting yoke, which is arranged to be brought into engagement with a unitary load 21, such as a container or the like, from the top of the same.

Figure 2:
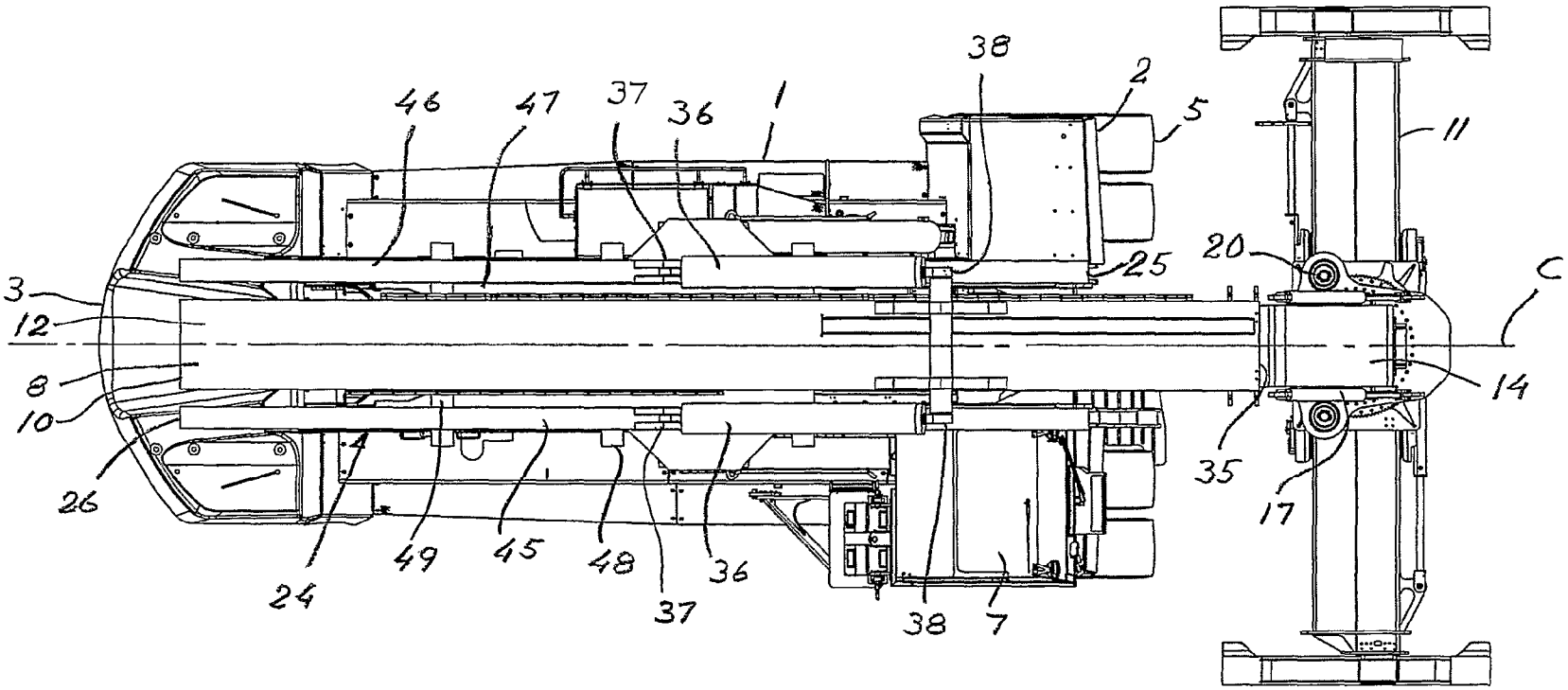
FIG. 2 is a top view of the boom truck.

The boom truck comprises a support structure 23 for mounting in bearings and supporting the telescopic lifting boom 8. The support structure 23 comprises a first support 28, which is arranged on the chassis 1 at its rear portion for extending in a direction upwards, and a second support in the form of a stable, elongated, linear bearing and support beam body 24 for mounting in bearings and supporting the lifting boom 8. The bearing and support beam body 24 extends in the longitudinal direction of the boom truck, from a position in the vicinity of and inside the rear end 3 of the chassis 1 to a position at or in the vicinity of the front end 2 of the chassis 1, as is evident from FIGS. 1 to 3. The longitudinal centre axis of the bearing and support beam body 24 coincides with the longitudinal, vertical centre plane C of the boom truck, which thus intersects the axes of the pairs of wheels 5, 6 at right angles. The bearing and support beam body 24 has a front end 25, which is located in the vicinity of the front end 2 of the chassis, a rear end 26, which is located in the vicinity of the rear end 3 of the chassis 1, and a central portion 27, which is located between said ends 25, 26. In the embodiment shown, the bearing and support beam body 24 is made of two stable, elongated, parallel side beams 45, 46, which have the same rectangular cross sections and are standing on their edges. The side beams 45, 46 are arranged at a predetermined distance from each other to delimit an upwardly open space 47 between themselves for receiving a major portion of the lifting boom 8 in its down-tilted starting position or transport position. The side beams 45, 46 are rigidly connected to each other by means of three U-shaped connecting elements 48 enclosing the side beams 45, 46 from below, wherein the transverse bottom members 49 of the connecting elements 48 form supports upon which the lifting boom 8 can rest. Accordingly, in the embodiment shown and described more closely in the foregoing, the bearing and support beam body 24 can be designated as a framework.

In the embodiment shown, the first support 28 is fixedly mounted to the top side of the chassis 1 at a position located between the rear end 3 of the chassis 1 and the central portion 4 of the chassis 1. In the embodiment shown, this position is located in the vicinity of and in front of the rear pair of wheels 6. The support 28 extends in a direction upwards, having a predetermined length from the chassis 1, for supporting the bearing and support beam body 24 via a rear bearing device, which forms a horizontal, rear bearing axis 30, which is perpendicular to the vertical centre plane C of the boom truck intersecting the axes of the pairs of wheels 5, 6. Accordingly, the bearing and support beam body 24 is pivotally mounted to the rear support 28 about said rear bearing axis 30. This rear bearing axis 30, formed by the rear bearing device, is located vertically above a point which is located in front of the centre axis of the rear pair of wheels 6, and at a small distance from said centre axis. According to an alternative embodiment, the rear support 28 is pivotally mounted to the chassis for displacing the bearing and support beam body back and forth in a pivoting movement. According to another alternative embodiment, the rear support is displaceably mounted to the support for displacing the bearing and support beam body back and forth in an axial movement (see below) for setting the same into desired positions. In the embodiment shown, the rear support 28 is formed by two plate-shaped, vertical supporting elements, which are arranged on each side of the centre plane C of the boom truck.

Figure 4:
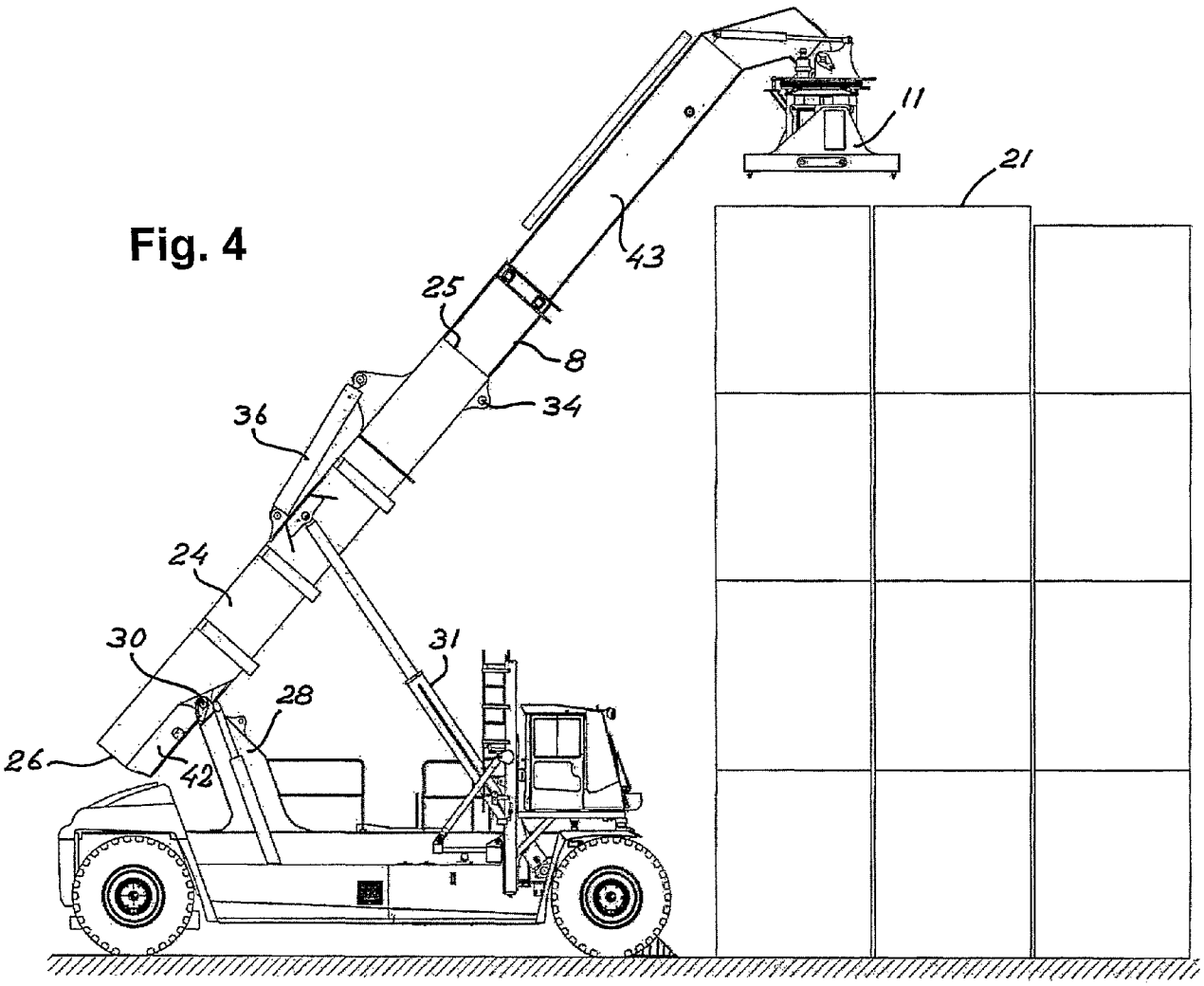
FIG. 4 is a side view of the boom truck in FIGS. 1 and 2 in an operative position at a container terminal for collecting or stacking containers.

Furthermore, the support structure 23 comprises an actuator 31 for raising and lowering the bearing and support beam body 24 relative to the chassis 1, with controlled pivoting about the rear bearing axis 30, which actuator 31 extends between the chassis 1 and the bearing and support beam body 24 and is pivotally connected to the chassis 1 and the bearing and support beam body 24. In the embodiment shown, the actuator 31 consists of two hydraulic cylinders, which are mounted on each side of the bearing and support beam body 24. At its lower end, each hydraulic cylinder/actuator 31 is pivotally mounted to the chassis 1 by a bearing device 32, which is located in the vicinity of and behind the front pair of wheels 5, and is at its upper end pivotally mounted to the bearing and support beam body 24 on a vertical outer side of the same at a bearing device 33, which is located at the central portion 27 of the bearing and support beam body 24 and thus at a distance from the rear bearing axis 30, about which the bearing and support beam body 24 is pivotally mounted to the rear support 28, said distance being predetermined to achieve the required lever action and lifting capacity of the two hydraulic cylinders 31. It is appreciated that the upper and lower bearing devices 33, 32 of one hydraulic cylinder 31 form bearing axes, which coincide with the bearing axes of the opposite upper and lower bearing devices 33, 32, respectively, of the other hydraulic cylinder 31. By actuating the two hydraulic cylinders 31, the bearing and support beam body 24 can be pivoted about the rear bearing axis 30 at the rear support 28 in order to pivot the bearing and support beam body 24 to a desired raised position obliquely upwards/forwards and back to its horizontal starting position in a controllable way, when this is desired for the handling of containers 21, which are located at and above the ground level. The bearing and support beam body 24, and thereby the lifting boom 8, can then be pivoted together up to a desired oblique position, where the bearing and support beam body 24 and the lifting boom 8 form an acute angle to the horizontal plane, as illustrated in FIG. 4, which angle can be up to 65° . The first or rear support 28 has a sufficient length such that the bearing axis 30 becomes located at a sufficient level above the chassis 1, so that the bearing and support beam body 24 can be arranged in a horizontal starting position, in accordance with FIG. 1, by means of the actuator 31. At the same time, the actuator 31 must have a sufficient length in order to obtain a sufficient length of stroke to be capable of pivoting the bearing and support beam body 24 with lifting boom 8 up to a sufficient maximum working height. Because of these considerations, the bearing and support beam body 24 will assume a horizontal starting position with its bottom side on a level with the cab's 7 roof, or just below or above the same. At the same time, the bearing axes 30 and 34 of course will have to be located at levels ensuring a sufficiently low centre of gravity of the boom truck.

The lifting boom 8, which has been described more closely in the foregoing, is pivotally mounted to the bearing and support beam body 24 in the vicinity of the front end 25 of the bearing and support beam body 24 by means of a front bearing device, forming a horizontal front bearing axis 34, which is perpendicular to the vertical centre plane C of the boom truck. In the embodiment shown, this front bearing axis 34 is located vertically above the centre axis of the front pair of wheels 5. Furthermore, the front bearing axis 34 is located at a predetermined distance from the free rear end 10 of the rear base portion 12, i.e. the lifting boom 8, and at a substantially closer distance to the front end 35 of the rear base portion 12, from which the telescopic arm 13 projects. Accordingly, the front bearing axis 34 divides the lifting boom 8 into a rear tilting section 42 and a front tilting section 43, wherein the rear tilting section 42 is adapted to assume a down-tilted position parallel to the bearing and support beam body 24—wherein the boom truck can handle unitary loads 21 above the ground level while raising the bearing and support beam body 24, when thus the front tilting section 43 projects linearly from the bearing and support beam body 24, as shown in FIG. 4—and an up-tilted position, in which it forms an acute angle with the bearing and support beam body 24, wherein the boom truck 8 can handle unitary loads 21 below the ground level since the front tilting section 43 is tilted down to a corresponding degree, as shown in FIG. 3.

If desired, the bearing and support beam body 24 can alternatively be extended in a direction forwards with a predetermined length to displace said front bearing axis 34 outwards to a corresponding degree in order to achieve a better reach in toward the side of a barge 40 located closest to a dock's edge 41, since it becomes possible to increase the degree of inclination (see below) of the lifting boom 8. In this case, however, it might be necessary to arrange a corresponding counterweight at the rear end portion of the chassis 1 in order to compensate for the reduced load which may be caused at the rear pair of wheels 6 due to the increased lever action which is produced at the front end of the boom truck 8. When desired or when such a need arises, such a displacement of the front bearing axis 34 can alternatively be realized by making the bearing and support beam body 24 in two separate parts, that is to say a front portion and a rear portion, which portions are in stable engagement with each other and axially displaceable relative to each other by means of an actuator, wherein thus the front portion supports the front bearing device, which forms the bearing axis 34. In this case, the front portion can for example be constituted of an elongated sledge, which travels or slides linearly inside the rear portion of the bearing and support beam body. The displacement of the position of the front bearing axis is within the range from close to 0 mm to about 1500 mm.

The lifting boom 8 further comprises an actuator 36 for pivoting or tilting the lifting boom 8 about its bearing axis 34 relative to the bearing and support beam body 24, which actuator 36 extends between the bearing and support beam body 24 and the rear base portion 12 of the lifting boom 8 and which is pivotally connected to the bearing and support beam body 24 and the rear base portion 12 by means of bearing devices 37, 38. In the embodiment shown, the actuator 36 is constituted of two double acting hydraulic cylinders, which are mounted on each side of the rear base portion 12 of the lifting boom 8 and each with one of its ends, or rear end, pivotally mounted in bearings to the top side of the bearing and support beam body 24 at a bearing point of the bearing device 37, which is located on a central portion 27 of the bearing and support beam body 24, and with its other end, or front end, at a bearing point of the bearing device 38 which is located on a lug 39 of the bearing device 38, which lug 39 projects a suitable distance from the top side of the rear base portion 12, wherein this second or front bearing point of the bearing device 38 is located between the front bearing axis 34 of the lifting boom 8 and said first or rear bearing point of the bearing device 37, and wherein the distance between the second or front bearing point and the front bearing axis 34 of the lifting boom 8 is predetermined so that the required lever action can be obtained with the pivoting force which is applied by the hydraulic cylinders 36, which have sufficient lengths of stroke for pivoting the lifting boom 8 to desired tilted positions.

Figure 3:
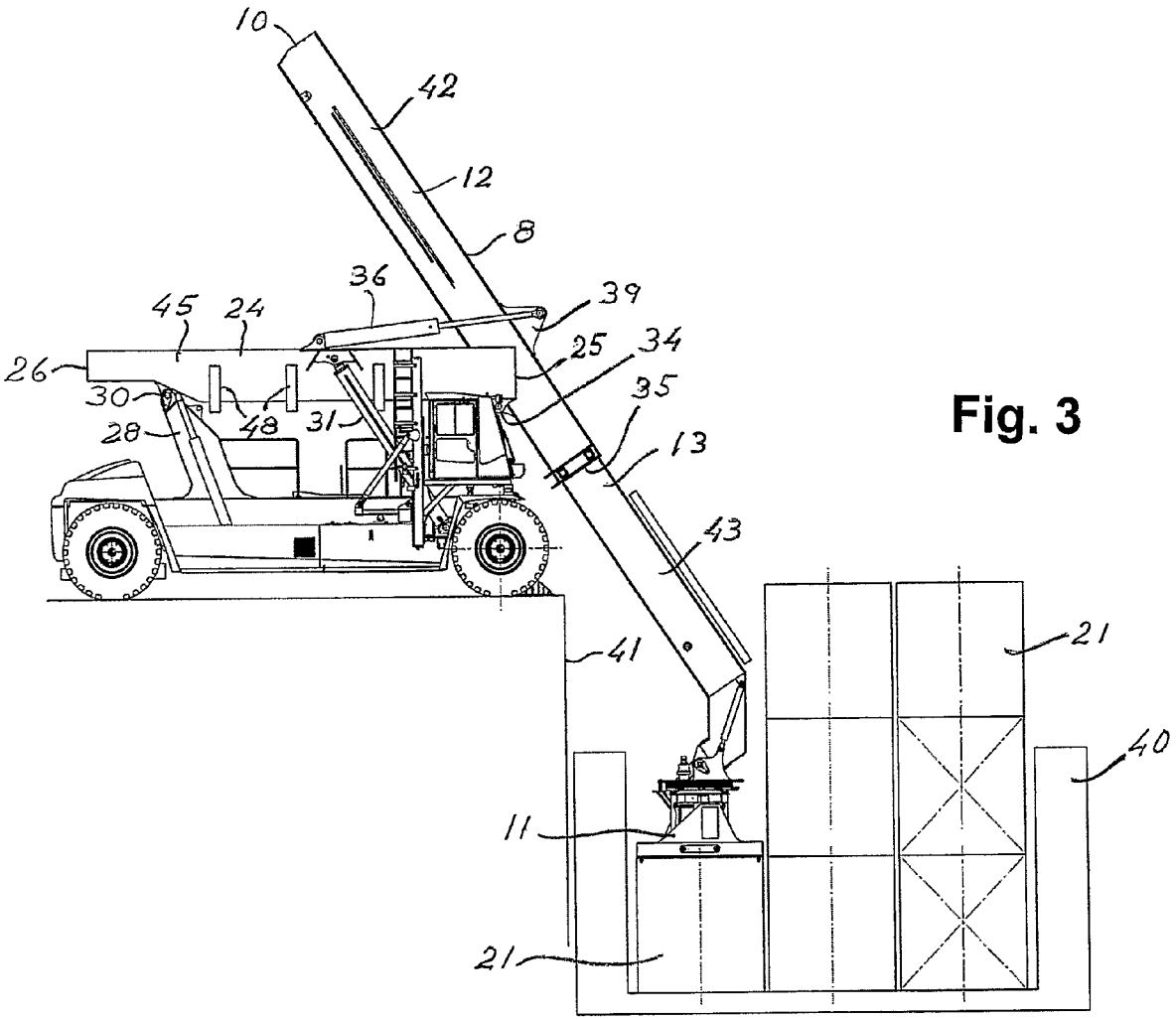
FIG. 3 is a side view of the boom truck according to FIGS. 1 and 2 in an operative position at a dock's edge for loading or unloading a container barge, which is in a position close to the dock's edge.

The hydraulic cylinders 36 for pivoting the lifting boom 8 about its front bearing axis 34 are adapted for setting the lifting boom into different tilted or inclined positions for handling a container 21 also below ground level, e.g. in connection with loading or unloading of a ship, e.g. a barge, as illustrated in FIG. 3. The lifting boom 8 can be tilted into a lower position, in which the lifting boom 8 forms a small acute angle with a vertical plane, intersecting the vertical centre plane C of the boom truck at right angles. In general, this angle is suitably 40° or smaller, preferably 30° or smaller. In the embodiment shown, this angle is about 30° . It can of course be made even smaller, e.g. down to 0° , or even past the vertical line, in order to form a small acute, negative angle, depending on the position of the bearing axis 34 outside, or in front of, a vertical plane intersecting the centre axis of the front pair of wheels 5, by extending the bearing and support beam body 24 in itself or dividing it into two parts which are displaceable relative to each other, or displacing the bearing and support beam body 24 forward in a pivoting movement or axial movement by means of a pivotally and displaceably, respectively, mounted support 28, in accordance with the alternative methods described in the foregoing.

The bearing and support beam body can of course be designed in many different ways, where the common feature of the embodiments is that the rear chassis support can be mounted to the rear end portion of the beam body and the lifting boom can be mounted to the front portion of the beam body, and that the beam body is capable of supporting the lifting boom and the load it is carrying, including container with goods, lifting unit and connecting part 14, which load can amount to 45 tons or more, and which load the beam body transfers to the actuator for pivoting the beam body. According to such an alternative embodiment, the beam body has a bottom beam, which has a rectangular cross-section and which is solid along its entire length or provided with vertically extending, material-saving through openings, wherein rod or plate shaped struts can be arranged along the sides of the bottom beam in order to form the previously mentioned space for the lifting boom.

The invention claimed is:

1. A boom truck for handling a container with a weight of up to 45 tons, both above as well as below ground level, comprising:

an elongated chassis having a front end, and a rear end, a front pair of wheels, a rear pair of wheels, a telescopic lifting boom having a base portion with a rear end and a front end, and a telescopic arm defining the front end of the lifting boom, wherein the lifting boom is pivotally mounted for pivoting in a vertical plane and extends above the chassis and past the front pair of wheels, a lifting unit, which is arranged in connection to the front end of the lifting boom and, with the lifting boom in a retracted position, is separated by a space from the front end of the chassis for carrying the container, a support structure for supporting the lifting boom, said support structure comprising a first support arranged on the chassis at the rear portion thereof, for extending in a direction upwards, wherein the lifting boom is non-articulated and the front end of the lifting boom is equipped with a top lifting yoke for handling the container, the support structure further comprises a second support, in the form of an elongated, linear bearing and support beam body for mounting and supporting the lifting boom, said bearing and support beam body extending in the longitudinal direction of the boom truck and having a rear end located substantially in alignment with the rear end of the chassis, and a front end located substantially in alignment with the front end of the chassis, the bearing and support beam body has a fixed length and is pivotally mounted to the first support about a horizontal, rear bearing axis located substantially in alignment with the rear end of the bearing and support beam body, the lifting boom is pivotally mounted to the bearing and support beam body about a horizontal, front bearing axis, which is parallel with the rear bearing axis and which is located substantially in alignment with the front end of the bearing and support beam body and substantially in alignment with the front end of the base portion of the lifting boom, and the support structure further comprises a rear actuator for raising and lowering the bearing and support beam body and the lifting boom as a unit, while pivoting about the rear bearing axis during said handling of the container above the ground level, and a front actuator for pivoting the lifting boom about the front bearing axis during said handling below the ground level, wherein the front actuator is connected between a first bearing device secured to the bearing and support beam body and a second bearing device secured to the base portion of the lifting boom, the second bearing device being positioned above the lifting boom such that the front actuator extends above the lifting boom.

2. The boom truck according to claim 1, wherein the front bearing axis divides the lifting boom into a rear tilting section and a front tilting section, wherein the rear tilting section is adapted to assume a down-tilted position parallel to the bearing and support beam body, and an up-tilted position, in which it forms an acute angle with the bearing and support beam body.

3. The boom truck according to claim 1, wherein the first support has a sufficient length such that the rear bearing axis becomes located at a sufficient level above the chassis so that the bearing and support beam body can be arranged in a horizontal starting position by means of the rear actuator and wherein the rear actuator thereby has a sufficient length to obtain a sufficient length of stroke in order to be capable of pivoting the bearing and support beam body with the lifting boom up to a sufficient maximum working height, wherein the bearing and support beam body is adapted to assume a horizontal starting position with a bottom side on a level with a cab roof.

4. The boom truck according to claim 1, wherein the rear actuator for the bearing and support beam body is mounted to the chassis with a bearing device located behind the front pair of wheels, and to the bearing and support beam body at a bearing device located at the central portion of the bearing and support beam body.

5. The boom truck according to claim 1, wherein the bearing and support beam body and the lifting boom are adapted to be pivoted as a unit up to an inclined position, in which said unit forms an angle from 0° to 65° with the ground plane.

6. The boom truck according to claim 1, wherein the lifting boom is adapted to be pivoted about said front bearing axis down to a lower position, in which the lifting boom forms an acute angle which is 40° or smaller with a vertical line.

7. The boom truck according to claim 1, wherein the front bearing axis is located in a position vertically above the center axis of the front pair of wheels.

8. The boom truck according to claim 1, wherein in a lowered position, a forward end of the bearing and support beam body is disposed forward of a vertical plane, intersecting the center axis of the front pair of wheels, and wherein the front bearing axis is located at a corresponding extended distance from said vertical plane in order to achieve a larger degree of inclination of the lifting boom.

9. The boom truck according to claim 1, wherein the bearing and support beam body comprises a rear portion and a front portion, said front portion being displaceably mounted on the rear portion for setting the front bearing axis into desired positions in front of the vertical plane intersecting the center axis of the front pair of wheels, in order to achieve a larger degree of inclination of the lifting boom.

10. The boom truck according to claim 1, wherein the first support is rigidly connected to the chassis.

11. The boom truck according to claim 1, wherein the first support is pivotally or displaceably mounted to the chassis and is provided with a support actuator for pivoting or displacing, respectively, the first support relative to the chassis with corresponding displacement of the bearing and support beam body in a direction forwards and simultaneous corresponding displacement of the position of the front bearing axis forwards relative to a vertical plane intersecting the center axis of the front pair of wheels, in order to set the desired degree of inclination of the lifting boom.

12. The boom truck according to claim 11, wherein the displacement of the position of the front bearing axis is within the range from close to 0 mm to about 1500 mm.

13. The boom truck according to claim 11, wherein the first support is adapted to be pivoted forward from a down-tilted, rear position to a desired up-tilted position for corresponding displacement forwards of the front bearing axis.

14. The boom truck according to claim 1, wherein the bearing and support beam body is designed as a framework having a space, which has delimitations in a transverse direction and is open upwards in order to be available for receiving and accommodating at least a portion of the lifting boom in its position for handling of the container above ground.

15. The boom truck according to claim 14, wherein said transverse delimitations comprise two parallel, elongated side beams arranged at a distance from each other for delimiting said space between themselves.

16. The boom truck according to claim 15, wherein the bottom part of the framework comprises a plurality of connecting elements, which are rigidly connected to the bottom sides of the side beams.

* * * * *

UNITED STATES PATENT AND TRADEMARK OFFICE

CERTIFICATE OF CORRECTION

PATENT NO. : 8,899,905 B2
APPLICATION NO. : 12/810604
DATED : December 2, 2014
INVENTOR(S) : Helgesson It is certified that error appears in the above-identified patent and that said Letters Patent is hereby corrected as shown below:

On the Title Page, Item (57) ABSTRACT, line 7:
change "mounted to beam" to --mounted to the beam--

In the Specification

At column 6, line 26, delete "8" after "at the front end of the boom truck"

Signed and Sealed this
Tenth Day of March, 2015

Michelle K. Lee

Michelle K. Lee
*Deputy Director of the United States Patent and Trademark Office*